US005633617A

United States Patent [19]

Tsujiguchi et al.

[11] Patent Number: 5,633,617

[45] Date of Patent: May 27, 1997

[54] DIELECTRIC BANDPASS FILTER

[75] Inventors: Tatsuya Tsujiguchi; Haruo Matsumoto, both of Kanazawa, Japan

[73] Assignee: Murata Manufacturing Co., Ltd., Japan

[21] Appl. No.: 397,485

[22] Filed: Mar. 2, 1995

[30] Foreign Application Priority Data

Mar. 2, 1994 [JP] Japan ..... 6-032478

[51] Int. Cl.[6] ..... H01P 1/205

[52] U.S. Cl. ..... 333/206; 333/222; 439/608

[58] Field of Search ..... 333/202, 206, 333/207, 219.1, 182, 222; 439/86, 276, 608, 752, 931, 936

[56] References Cited

U.S. PATENT DOCUMENTS 4,506,241 3/1985 Makimoto et al. ..... 333/206 X
5,166,649 11/1992 Aizawa et al. ..... 333/206 X
5,412,359 5/1995 Kazama et al. ..... 333/206

*Primary Examiner*—Paul Gensler
*Attorney, Agent, or Firm*—Ostrolenk, Faber, Gerb & Soffen, LLP

[57] ABSTRACT

To reduce the number of components and enable the mounting work of a filter unit onto a printed substrate without using a metal case, a filter unit of three-state structure with resonators is constructed in which an electrode is formed on an inner peripheral surface of each through-hole and an outer peripheral surface of a dielectric member except for one end face, and connector terminals each composed of a pin and an insert member are inserted into opening portion of the end face of the through-holes to form a dielectric bandpass filter. An enlarged insert portion is formed in the opening portion of each through-hole so as to form a stepped portion between the insert portion and a non-insert portion. The insert member has the same configuration as that of the insert portion and is inserted and fitted in the insert portion without projecting from the end face. At the same time, the movement of the insert member toward the non-insert portion is restricted by the stepped portion. The connector terminals are mounted in a stationary manner in a predetermined position within the through-holes.

28 Claims, 5 Drawing Sheets

FIG. 1
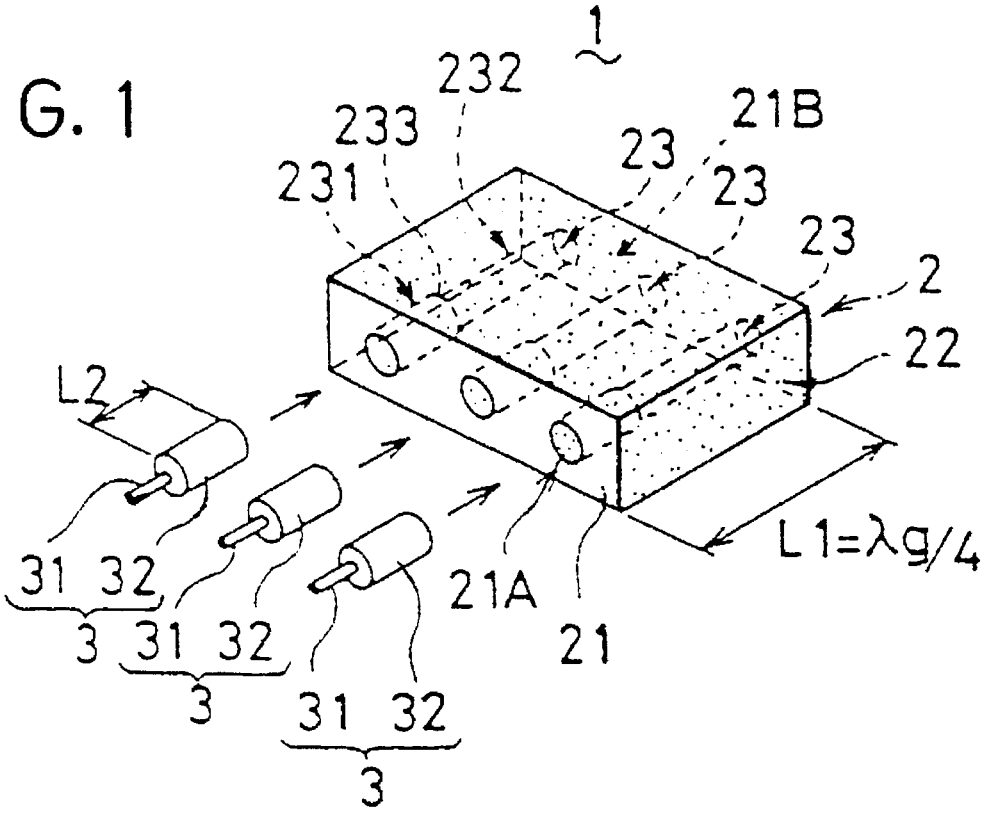
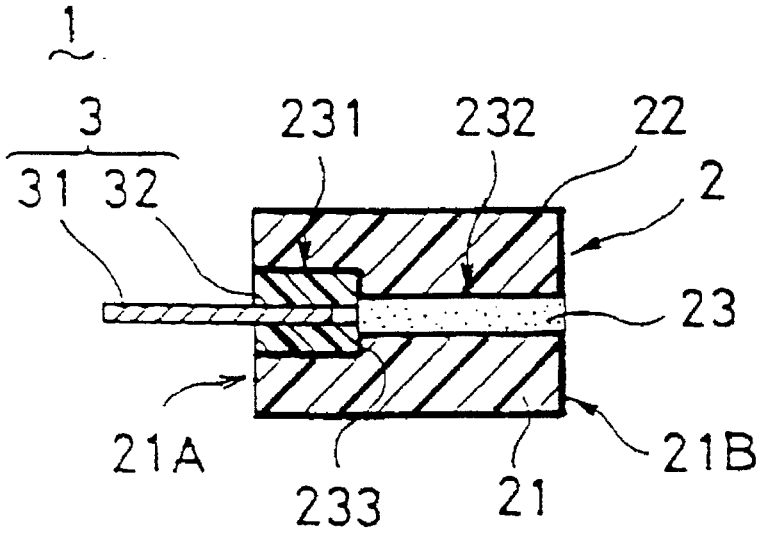
FIG. 2

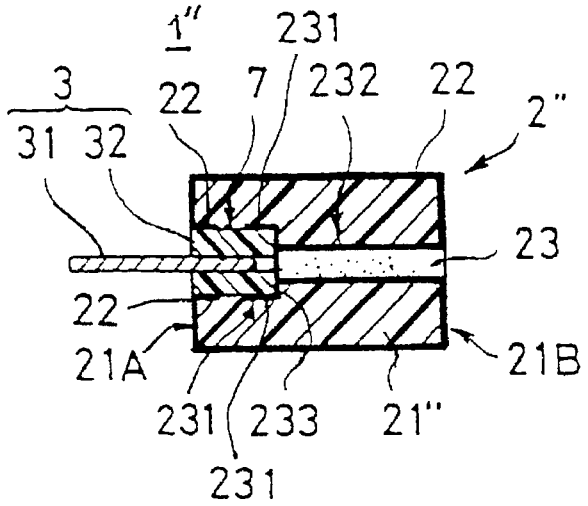
FIG.10A
FIG.10B
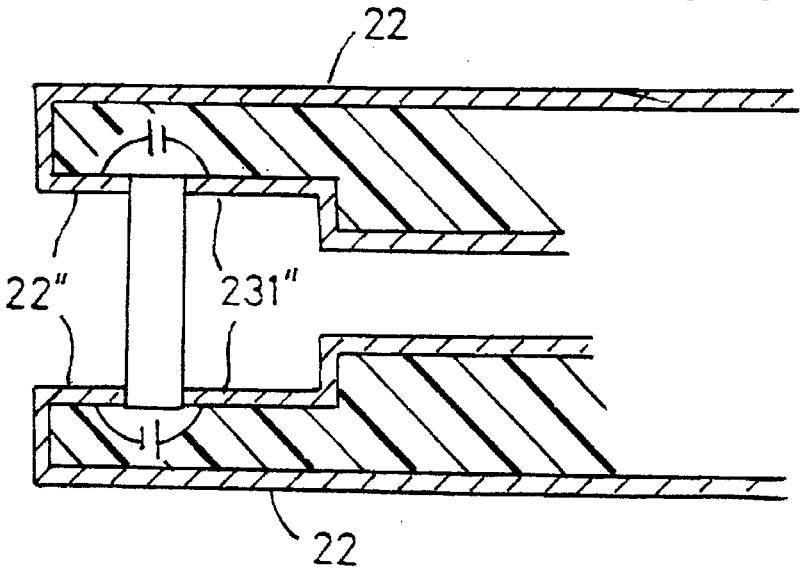
FIG.11
PRIOR ART
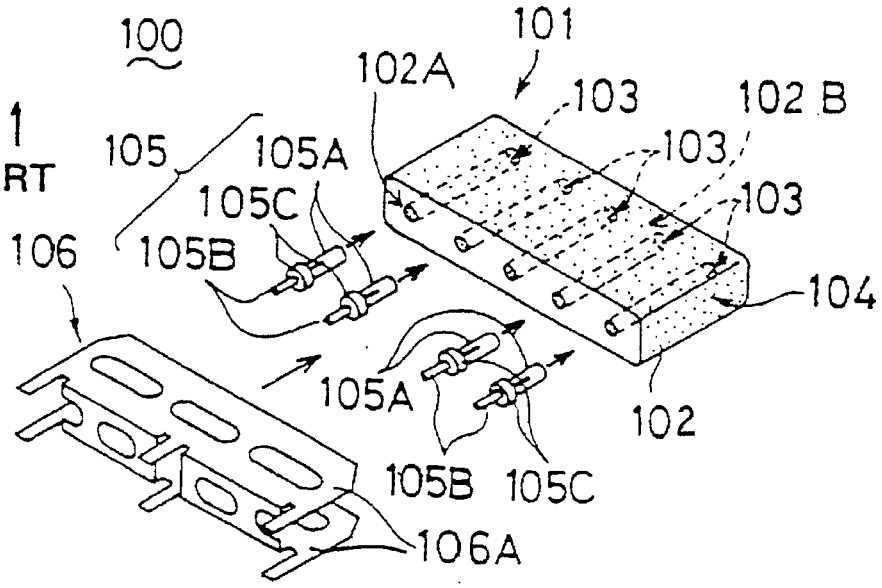

DIELECTRIC BANDPASS FILTER

BACKGROUND OF THE INVENTION

The present invention relates to a dielectric filter using coaxial resonators in which an electrode is formed on inner peripheral surfaces and outer peripheral surfaces of a parallelepiped-shaped dielectric member through which holes are formed in an axial direction, and it relates more particularly to a structure of a connector terminal associated with each coaxial resonator for input-output of a signal.

FIG. 11 is an exploded perspective view showing a primary part of a conventional dielectric filter.

The conventional dielectric bandpass filter 100 has a parallelepiped shape having a laterally extending rectangular cross section. The dielectric filter 100 is composed of a filter unit 101 having an electrode 104 (indicated by dots in FIG. 11) made of silver, copper or the like formed on outer peripheral surfaces of a parallelepiped dielectric member 102, which has five parallel through-holes 103 each extending in the axial direction, with the electrode 104 further extending onto inner peripheral surfaces of the respective through-holes 103; a plurality of connector terminals 105 for input-output of signals to and from the filter unit 101; and a metal case 106 for mounting the filter unit 101 onto a printed substrate (not shown).

The filter unit 101 is integrally made of filter blocks comprising five longitudinally connected coaxial resonators, terminals of which are short-circuited with each other. The electrode 104 formed in the inner peripheral surface of each through-hole 103 of the dielectric member 102 constitutes an inner conductive member of each coaxial resonator. The electrode 104 formed on the outer peripheral surface that is parallel with the through-hole 103 of the dielectric member 102 constitutes an outer conductive member of each coaxial resonator. The outer and inner conductive members are short-circuited by the electrode 104 that is formed on one end face 102B of the dielectric member 102.

Each connector terminal 105 is composed of an insert member 105A made of insulating material such as polymethylpentene and a pin 105B obtained by plating a surface of a steel wire such as brass with soldering material. The insert member 105A has the same cross-section as that of the above-described through-holes 103 with a flange portion 105C being formed at its proximal end portion. The flange portion is used to prevent the insert member 105A from being fully inserted into the through-hole 103.

The insert member 105A of each connector terminal 105 is inserted by pressing into the associated through-hole 103 of the dielectric member 102 so that the proximal portion of the pin 105B is supported on the axis of the through-hole 103.

The metal case 106 is used for grounding the filter and for preventing the connector terminals 105 from being pulled apart from the through-holes 103 upon actually mounting the dielectric filter 100 onto the printed substrate. The end portion of the filter unit 101, on the side of the open end face 102A, is inserted between a pair of mounting plates 106A, and the mounting plates 106A are attached and fixed to the outer conductive electrode 104 by soldering or the like.

In the conventional dielectric filter 100, since the flange portion 105C is provided at the proximal end portion of each insert member 105A and the flange portion 105C is arranged between the open end face 102A of the dielectric member 102 and the metal case 106 for preventing the insert members 105A from being pulled apart from the through-holes 103 and from being fully inserted into the through-holes 103, it is necessary to use the metal case 106, which leads to an increased number of assembly steps and an increased cost.

Also, if, in order to reduce the actual mounting area required, an arrangement is adopted in which the dielectric filter 100 is mounted on the printed substrate with the open end face 102A of the filter unit 101 facing the actual mounting surface of the printed substrate, the above-described flange portions 105C are interposed between the open end face 102A of the filter unit 101 and the actual mounting area of the printed substrate, which then leads to unstable mounting of the dielectric filter 100.

SUMMARY OF THE INVENTION

In view of the foregoing defects inherent in the conventional system, an important advantage of the present invention is to provide a dielectric bandpass filter which is mountable in the form of a filter unit while having a reduced number of components.

According to a first aspect of the present invention, there is provided a dielectric filter composed of a filter unit in which an electrode is formed at least on an inner peripheral surface of at least one hole extending in the axial direction in a parallelepiped-shaped dielectric member and on an outer peripheral surface in parallel with the hole to form an inner conductive member and an outer conductive member of a coaxial resonator, and a conductive terminal inserted into and mounted on the hole via an insert member made of dielectric material, for input-output of signals, in which the hole has an insert portion at its opening having a predetermined dimension and a predetermined cross-section into which the insert member is inserted; a stepped portion is provided between the insert portion and a non-insert portion contiguous with the insert portion for restricting the movement of the insert member toward the non-insert portion; and the insert member inserted into the insert portion is prevented from moving toward the non-insert portion by the stepped portion.

According to the first aspect of the invention, the conductive terminal for input-output of signals is mounted on a center axis of the hole by inserting the insert member into the hole of the filter unit. The conductive terminal is capacitively coupled with the inner conductive electrode of the coaxial resonator formed on the inner peripheral surface of the insert portion of the hole, for conducting high frequency signals.

When fitted in the insert portion, the movement of the insert member toward the non-insert portion is restricted by the stepped portion whereby the mount position of the conductive terminal is fixed in the filter unit. Also, the axial dimension of the insert member is set to be equal to or less than the axial dimension of the insert portion to thereby avoid any risk that the insert member would project from the open end face of the hole.

According to a second aspect of the present invention, the hole may be a through-hole and the insert portion may be formed at at least one of the open ends of the hole.

According to the second aspect of the invention, the insert portions may be formed at both end portions of the through-hole, and the conductive terminal for input-output of signals may be inserted into one of the insert portions to thereby constitute the dielectric filter.

According to a third aspect of the invention, the inner conductive member and the outer conductive member of the coaxial resonator are short-circuited at distal ends by at least one electrode formed on an end terminal face of the dielectric member.

According to the third aspect of the invention, the electrodes formed on the inner peripheral surface of the hole and the outer peripheral surface in parallel with the hole are short-circuited by the electrode formed on all the end faces of the dielectric member on which the conductive terminal is not mounted, thus forming a filter unit composed of the resonator with terminals being short-circuited.

According to a fourth aspect of the invention, the electrode is formed on both end faces and over the entire outer peripheral surface in parallel with the hole, and the electrode is provided with a predetermined gap within the through-hole adjacent to the insert portion of the inner peripheral surface of said hole.

According to the fourth aspect of the invention, the ends of the electrodes formed on the inner peripheral surface of the hole and the outer peripheral surface parallel with the hole are short-circuited by the electrodes formed over the end faces of the dielectric member where the conductive terminal is not mounted; the base ends of the electrodes formed on the inner peripheral surface of the hole and the outer peripheral surface parallel with the hole are capacitively coupled by the gap provided at the insert portion of the hole; and the filter unit is composed of the coaxial resonator whose inner conductive member is shielded by the outer conductive member. Since the periphery of the capacitance connector is shielded from the outer conductive member, there would be very little leakage of a high frequency signal from the capacitance connection portion.

According to a fifth aspect of the invention, a cross-section of the insert portion of said hole is different from a cross-section of the non-insert portion.

According to the fifth aspect of the invention, a stepped portion is formed by a difference in shape between the insert portion and the non-insert portion to prevent the insert member from shifting within the hole toward the terminal end face. The insert portion and the non-insert portion are preferably formed to have a similar cross sectional area to reduce the discontinuity of the surface area at the stepped portion of the inner conductive member to produce a smooth current flow.

According to a sixth aspect of the invention, the outer peripheral surface of the insert member is adhered to the inner peripheral surface of the insert portion of said hole.

According to the sixth aspect of the invention, the insert member for the connector terminal is adhered to the inner peripheral surface of the insert portion of the hole, whereby the insert member is prevented from being pulled apart from the hole.

According to a seventh aspect of the invention, said insert member has an axial dimension which is shorter than an axial dimension of the insert portion, and a recess generated at the insert portion is molded with resin.

According to the seventh aspect of the invention, under the condition that the insert member of the connector terminal is mounted in the insert portion, the recess generated in the insert portion is filled with resin, so that the insert member is prevented from being pulled apart from the hole.

According to an eighth aspect of the invention, said insert member is provided at a distal end integrally with a frictional portion, and said frictional portion is pressed into the non-insert portion contiguous with the insert portion of said hole.

According to the eighth aspect of the invention, the frictional portion of the insert member of the connector terminal may be inserted by pressing into the non-insert portion contiguous with the insert portion, and the insert member is prevented from being pulled apart from the hole by the frictional force generated between the frictional portion and the non-insert portion.

According to a ninth aspect of the invention, a retainer which is deformable in the radial direction and has a somewhat longer axial dimension than that of the non-insert portion of the hole with retainer pawls at its end is projected from the distal end of the insert member; the retainer passes through the non-inserted portion contiguous with the insert portion of the hole; and the retainer pawls are retained at the other open end face of the dielectric member.

According to the ninth aspect of the invention, under the condition that the distal end portions of the retainer are narrowed, the insert member of the connector terminal is caused to pass through the insert portion and the non-insert portion of the hole and is mounted on the dielectric member. When the retainer pawls are projected from the open end face of the non-insert portion of the hole to thereby return the distal end portions of the retainer back to the original state, the retainer pawls are retained at the end face of the dielectric member where the opening portion of the non-insert portion is formed, thus preventing the insert member from being pulled apart from the hole.

Other features and advantages of the present invention will become apparent from the following description of the invention which refers to the accompanying drawings.

BRIEF DESCRIPTION OF THE DRAWINGS

FIG. 1 is an exploded perspective view showing a dielectric filter according to a first embodiment of the invention;

FIG. 2 is a longitudinal sectional view showing the dielectric filter shown in FIG. 1;

FIG. 10A is a longitudinal sectional view showing the dielectric filter according to the sixth embodiment of the invention;

FIG. 10B is an exploded longitudinal sectional view of the filter shown in FIG. 10A; and FIG. 11 is an exploded perspective view showing a primary part of a conventional dielectric filter.

DESCRIPTION OF PREFERRED EMBODIMENTS

Figure 3A:
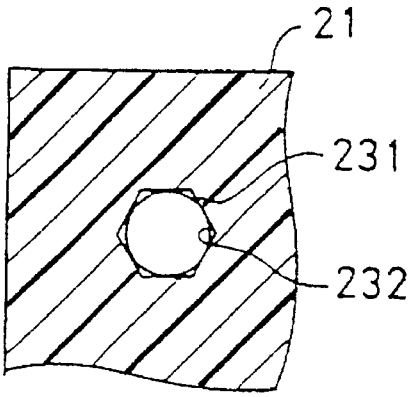
FIG. 3A is a cross-sectional view showing another shape of a hole provided in the dielectric member.

Embodiments of the present invention will now be described with reference to the accompanying drawings.

FIG. 1 is an exploded perspective view showing a dielectric bandpass filter according to a first embodiment of the invention, and FIG. 2 is a longitudinal sectional view showing the same dielectric filter.

A dielectric bandpass filter 1 is composed of a filter unit 2 which is obtained by integrally forming a multi-stage structure (three stages in the drawings) of dielectric filter elements, the multi-stage structure being formed by longitudinally connecting a plurality of dielectric coaxial resonators, having a respective plurality of connector terminals 3.

The filter unit 2 is integrally formed of three filter blocks which are composed of longitudinally connected ¼ wavelength coaxial resonators with their terminals short-circuited. The filter blocks are made by forming a metal film (hereinafter referred to as an electrode) 22 made of copper, platinum, silver, gold or the like on a surface of a dielectric member 21 made of ceramics or the like having a high dielectric constant.

More specifically, the dielectric member 21 is in the form of a parallelepiped shape having a laterally extending rectangular cross-section and an axial dimension L1 of about λg4 (λg: waveguide wavelength of resonant frequency) with three parallel extending axial through-holes 23. The metal electrode film 22 (indicated by dots in the drawings) is applied to inner peripheral surfaces of the through-holes 23, outer peripheral surfaces extending in parallel with the through-holes 23, and a first end face (hereinafter referred to as an end terminal face) 21B.

An enlarged insert portion 231 which is sized and shaped for receiving a connector terminal 3 which is to be pressed snugly into the enlarged insert portion 231, is formed on the side of an open end face 21A in each through-hole 23. The through-hole 23 has a circular cross section. A diameter of the enlarged insert portion 231 is larger than that of a non-insert portion 232 that is formed to be continuous with the insert portion 231, so that a stepped portion 233 (also referred to as a step) is formed between the insert portion 231 and the non-insert portion 232 (see FIG. 2). As will be described later in more detail, the stepped portion 233 forms an abutment for preventing the connector terminal 3 from being fully inserted into the through-hole 23.

It should be noted that a reason why the above-described insert portion 231 is larger in size than the above-described non-insert portion 232 is that the stepped portion 233 is formed therebetween. It is therefore possible to employ an alternative to the stepped portion 233 by providing the non-insert portion 232 and the insert portion 231 with different cross-sectional shapes. The insert portion 231 may have the same cross-sectional area as, or a different cross-sectional area from, the non-insert portion 232.

Figure 3B:
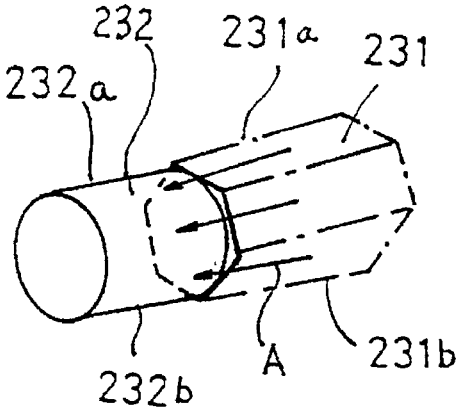
FIG. 3B is an exploded isometric view of the non-insert portion and insert portion shown in FIG. 3A.

For instance, it is possible to use the modification, shown in FIGS. 3A and 3B, in which the cross-sectional shape of the insert portion 231 of the through-hole 23 is triangular, rectangular or any other polygonal shape (for example, a hexagonal shape as in FIGS. 3A and 3B), the cross-sectional shape of the non-insert portion 232 is circular, so as to inscribe the polygonal shape of the insert portion 231. It is also possible for the cross-sectional shape of the insert portion 231 to be elliptical and for the cross-sectional shape of the non-insert portion 232 to be circular, to form the stepped portion 233. If the insert portion 231 of the hole 23 and the non-insert portion 232 thereof are formed substantially with the same cross-section, the change in surface area at the above-described stepped portion 233 in the internal guide structure provided by the inner conductive member is such that discontinuity of the electromagnetic field distribution within the guide structure may be advantageously reduced. That is, because the cross-sectional area of the insert portion is substantially the same as that of the non-insert portion, current flows smoothly between the insert portion and the non-insert portion as shown by the arrows A in FIG. 3B.

The electrode 22 is formed by applying electrode paste, made of copper, silver, platinum or the like, over the entire dielectric member 21 and thereafter baking the electrode paste at a predetermined temperature. It is also possible to form the electrode 22 by a non-electrolyte plating technique with copper, silver, tin or the like. The end face 21A (hereinafter referred to as an open end face) opposite the terminal end face 21B, of the dielectric member 21 is polished until the axial dimension has a predetermined value. Thus, the filter unit 2 is obtained.

It is also possible to set the axial dimension L1 of the dielectric member 21 at the predetermined dimension, apply the above-described electrode paste to the dielectric member 21 except for the open end face 21A, and bake the electrode paste, to form the filter unit 2.

It is further possible to preset the axial dimension L1 of the dielectric member 21 at the predetermined dimension, then mask the open end face 21A, and finally perform non-electrolytic plating with copper, silver, tin or the like, to thereby form the electrode 22 and obtain the above-described filter unit 2.

The inner conductive member for each coaxial resonator is constituted by the electrode 22 formed on the inner peripheral surface of each through-hole 23 of the dielectric member 21. The outer conductive member for each coaxial resonator is constituted by the electrode 22 formed on the outer parallel surface of the through-hole 23 of the dielectric member 21. The inner conductive member and the outer conductive member are short-circuited by the electrode 22 formed on the terminal face 21B of the dielectric member 21 (see FIG. 2). The respective ¼ wavelength resonators with short-circuited terminals are mutually connected by a magnetic component of the magnetic field formed in the dielectric member.

Each of the connector terminals 3 is composed of a pin 31 made of steel wire such as copper, silver, gold, aluminum or the like, and an insert member 32 made of insulating, material having a high dielectric constant, for supporting the pin 31 on the coaxial axis of the insert portion 231 of the through-hole 23. The above-described pin 31 is mounted along the center axis of the insert member 32.

The insert member 32 is made of synthetic resin such as polymethylpentene, polybutylene terephthalate (PBT) or the like having a low loss, and has the same cross-section as the insert portion 231, and an axial dimension L2 less than the axial dimension of the insert portion 231. Incidentally, it is preferred for the axial dimension L2 of the insert member 32 to be equal to or less than the axial dimension of the insert portion 231, so that the insert member 32 will be fully inserted into the insert portion 231 and its end face will be prevented from projecting from the open end face 21A of the dielectric member 21.

The connector terminal 3 is preferably mounted on the dielectric member 21 with the insert member 32 being press-fitted into the insert portion 231 of the through-hole 23. Incidentally, in order to positively prevent the connector terminal 3 from being pulled apart from the through-hole 23, it is further preferable to adhere the outer peripheral surface of the insert member 32 and the inner peripheral surface of the insert portion 231 of the through-hole 23 with an adhesive made of synthetic resin, for example.

The pin 31 of the connector terminal 3 is capacitively-coupled with the electrode 22 formed on the inner peripheral surface of the insert portion 231 of the through-hole 23. The pin 31 is thereby coupled with each coaxial resonator of the filter unit 2 through this capacitance for conducting high frequency signals.

Figure 7:
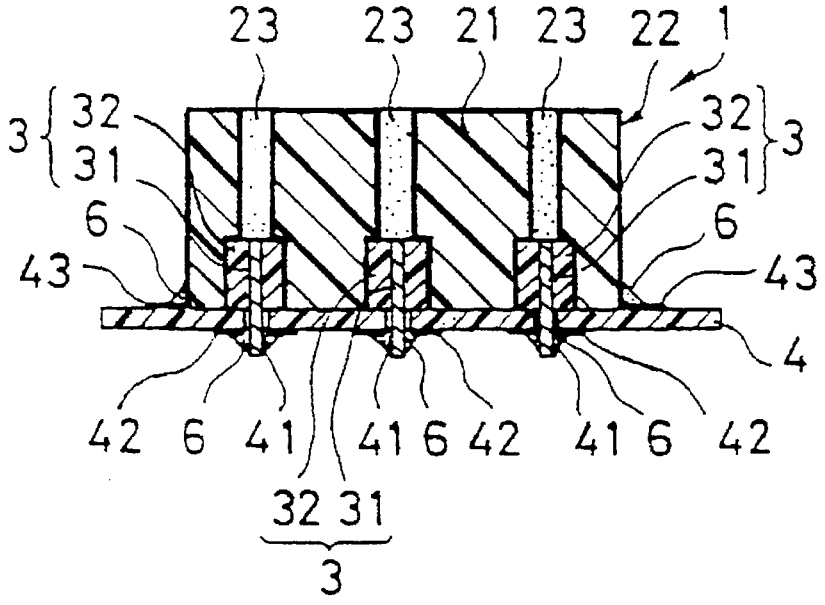
FIG. 7 is a cross-sectional view showing a state in which the dielectric filter according to the invention is actually mounted on the printed substrate.

FIG. 7 is a cross-sectional view showing a dielectric filter, for example the dielectric filter 1 shown in FIGS. 1–2, mounted on a printed substrate 4.

In the printed substrate 4, a hole 41 is formed in a position corresponding to a respective connector terminal 3 of the dielectric filter 1, and a predetermined circuit pattern is formed in predetermined positions including positions surrounding the holes 41 on the top and bottom surfaces of the printed substrate 4, and the position where the outer conductive member of the dielectric filter 1 is to come into contact.

The dielectric filter 1 is mounted on the top surface of the printed substrate with the three connector terminals 3 passing through the associated holes 41. A tip or distal end of the pin 31 of each connector terminal 3 is connected by solder 6 to a bottom surface electrode 42 of the printed substrate 4. At the same time, the predetermined portions, in the vicinity of the open end face 21A, of the outer conductive member 22 are connected to and mounted on a surface electrode 43 of the printed substrate 4 by solder 6.

As described above, since the stepped portion 233 is provided between the insert portion 231 and the non-insert portion 232 of the through-hole 23, and the insert member 32 of the connector terminal 3 inserted into the insert portion 231 is adhered to the through-hole 23, the insert member 32 is restricted from shifting within the through-hole 23 toward the terminal end face 21B by the stepped portion 233, and further, the insert member 32 is not movable relative to the through-hole 23.

Thus, the mounting position for the connector terminals 3 within the dielectric member 21 is fixed in place. The metal case that is needed for fixing the mount position of the connector terminals 3 in the conventional technique may be dispensed with. Accordingly, the structure of the dielectric filter is simplified to thereby reduce the number of assembling steps and the manufacturing cost.

Also, since the insert member 32 of the connector terminal 3 is fully received in the insert portion 231 of the through-hole 23, it is possible to directly attach the open end face 21A of the dielectric member 21 to the surface (actual mount surface) of the printed substrate 4 and stably mount the dielectric filter 1 directly onto the printed substrate 4 without any gap between the surface of the printed substrate 4 and the open end face 21A of the dielectric member 21.

Figure 4A:
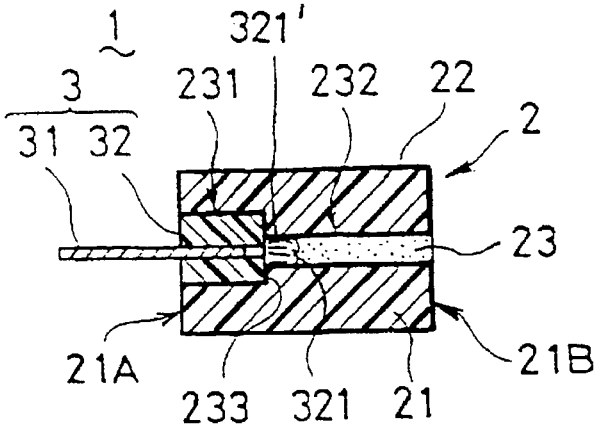
FIG. 4A is an exploded perspective view showing a dielectric filter according to a second embodiment of the invention.

FIG. 4A is a longitudinal cross-sectional view showing a dielectric bandpass filter according to a second embodiment of the invention.

Figure 4B:
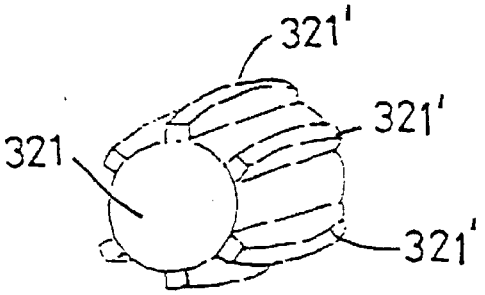
FIG. 4B is an exploded isometric view of the ridged frictional member shown in FIG. 4A.

In the second embodiment shown, a ridged frictional member 321 extends continuously from a distal end of the insert member 32. The frictional member 321 contains ridges 321' more clearly shown in FIG. 4B. The frictional member 321 having the ridges 321' is sized and shaped for being inserted by pressing into the non-insert portion 232 which is contiguous with the insert portion 231 of the through-hole 23 for preventing the insert member 32 from being pulled apart from the through-hole 23. It is possible to make the frictional member 321 and ridges 321' with material that is different from the material used to form the insert member 32, but it is preferable to form the frictional member 321 and ridges 321' integrally with the same material as that of the insert member.

Figure 5:
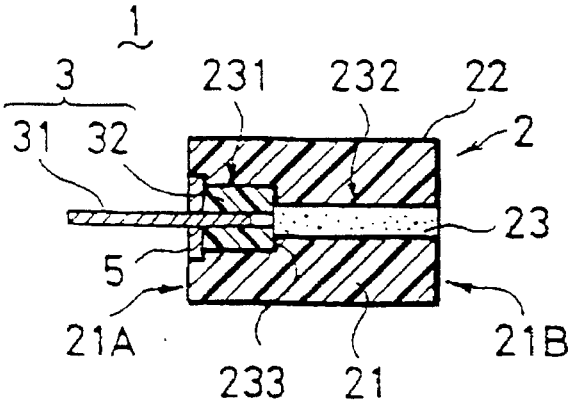
FIG. 5 is a longitudinal sectional view showing the dielectric filter according to a third embodiment of the invention.

FIG. 5 is a cross-sectional view showing a dielectric bandpass filter according to a third embodiment of the invention.

In the third embodiment shown, the axial dimension L2 of the insert member 32 is shorter than the axial dimension of the insert portion 231 of the through-hole 23, and upon inserting the insert member 32 into the insert portion 231, resin or the like is filled and molded into a recess which is left around the opening portion of the insert portion 231 for preventing the insert member 32 from being pulled apart from the through-hole 23. Alternatively, instead of the resin mentioned above, it is possible to fix a cover member 5, having the same shape as that of the recess, to the recess for preventing the insert member 32 from being pulled apart from the through-hole 23.

Figure 6:
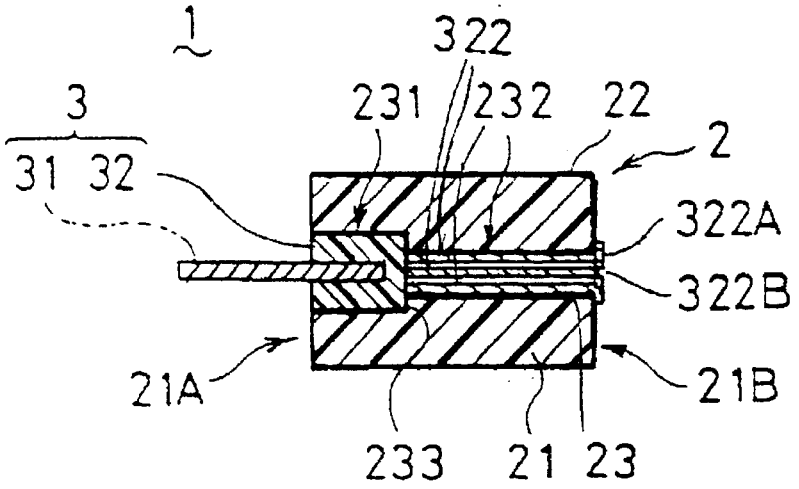
FIG. 6 is a longitudinal sectional view showing the dielectric filter according to a fourth embodiment of the invention.

FIG. 6 is a cross-sectional view showing a dielectric bandpass filter according to a fourth embodiment of the invention.

In the fourth embodiment shown, a plurality of retainers 322 having retainer pawls 322A at their ends are formed to extend from one end of the insert member 32, and the retainer pawls 322A of the retainers 322 are retained at the terminal face 21B of the dielectric member 2 for preventing the insert member 32 from being pulled apart from the through-hole 23.

The retainers 322 have a somewhat longer axial dimension than the non-insert portion 232 of the through-hole 23 and the end portions are bent outwardly in an L-shape to form the retainer pawls 322A. A suitable gap 322B is provided between the adjacent retainers 322 so that the end portion of each retainer 322 is deformable in the radial direction.

The insert member 32 is inserted into each through-hole 23 from the open end face 21A of the dielectric member 2, and mounted in a position with the tip or distal ends of each retainer 322 projecting from the terminal end face 21B of the dielectric member 2. The insert member 32 is inserted by first shifting the tip or distal ends of each retainer 322 inwardly into a tapered shape. When the retainer pawls 322A arrive at the terminal end face 21B, the shift of the tip end portions of the retainer 322 is released, so that the movement of the insert member 32 toward the open end face 21A within the through-hole 23 is thereafter restricted so as to prevent the insert member 32 from being pulled apart from the through-hole 23.

The foregoing embodiments have been explained in connection with a dielectric filter which is obtained by integrally forming the coaxial resonators with the short-circuited end terminals. It is however possible to apply the present invention to a dielectric filter which is obtained by integrally forming, for example, ½-wavelength coaxial resonators, wherein the end terminals are open, that is, not short-circuited.

Figure 8:
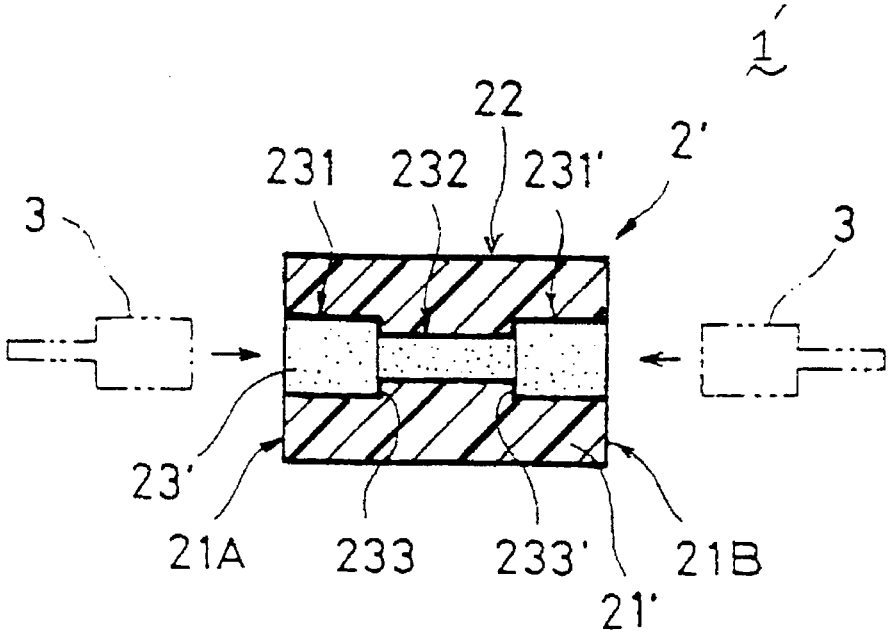
FIG. 8 is a longitudinal sectional view showing the dielectric filter according to a fifth embodiment of the invention.

In such a case, as shown in FIG. 8, a pair of identical insert portions 231 and 231' are provided at both end portions of the through-hole 23' formed in the dielectric member 21'. A connector terminal 3 may be inserted in either one of the end faces 21A and 21B of the dielectric member 21'.

Incidentally, the above-described dielectric member 21' shown in FIG. 8 may also be applied to construct a dielectric filter in which coaxial resonators are integrally formed with their end terminals being short-circuited. In this case, after the electrode 22 has been formed over the entire surface of the dielectric member 21' the electrode 22 is removed from either one of the end faces 21A and 21B to form a filter unit 2'. The connector terminal 3 is inserted into and mounted in the through-hole 23' from either one of the end faces 21A and 21B to thereby assemble the dielectric filter 1'.

As described above, in the dielectric member 21' provided with the through-holes 23' having the insert portions 231, 231' on both ends, the open end face is specified by the electrode formation or the electrode removal. Accordingly, the assembling work of the dielectric filters is advantageously simplified.

Figure 9:
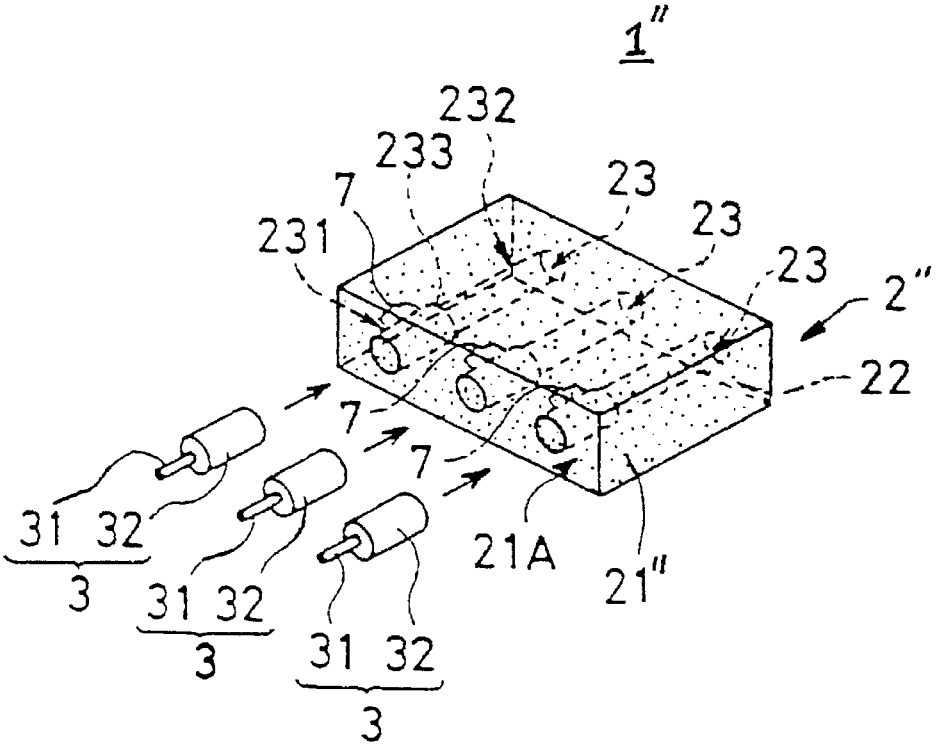
FIG. 9 is an exploded perspective view showing a dielectric filter according to a sixth embodiment of the invention.

FIG. 9 is an exploded perspective view showing a dielectric bandpass filter according to a sixth embodiment of the invention. FIG. 10A is a longitudinal sectional view showing the same dielectric bandpass filter.

FIGS. 9, 10A and 10B show a filter in which, unlike the filter in FIGS. 1 and 2, the electrode is formed over the entire surface of the end face 21A. Further, as in FIGS. 1 and 2, the electrode 22 formed on the inner peripheral surfaces of the through-holes 23 is short-circuited with the electrode 22 formed on the outer peripheral surfaces of the dielectric member 21" parallel with the through-holes 23. Finally, no electrode 22 is formed at the insert portion 231 of the through-hole 23, thus forming a predetermined gap 7 which is defined by the rectangular area shown in FIG. 10B.

In a filter unit 2" of the dielectric filter 1" according to the sixth embodiment, the outer conductive member of the coaxial resonators is formed to surround the end face 21A of the dielectric member 21" up to the open end of the insert portion of the through-hole 23. Thus, as clearly shown in FIG. 10B, the open end 231" of the inner conductive member at the stepped portion 233 is capacitively coupled to the outer conductive member 22" through a capacitance formed by the gap 7. In the dielectric filter 1", the open end portion of the coaxial resonators (i.e., the portion coupled through the gap 7) is shielded by the electrode (outer conductive member) 22 formed on the outer peripheral surface of the dielectric member 21" as shown in FIGS. 10A and 10B. Thus, leakage of a high frequency signal through the gap 7 is substantially prevented, so as to ensure filter characteristics with high reliability.

Incidentally, it is possible to apply, also in the above-described dielectric filter 1" of FIG. 9, the methods of preventing the pulling-out of the connector terminals 3 shown in FIGS. 4 through 6.

It is also possible to apply in the above-described filter 1" of FIG. 9, the dielectric member 21' provided with the insert portions 231 and 231' on both end portions of the through-hole 23 as shown in FIG. 8.

Various details of the invention may be changed without departing from either its spirit or its scope. Furthermore, the foregoing description of the embodiments according to the present invention is provided for the purpose of illustration only, and not for the purpose of limiting the invention as defined by the appended claims and their equivalents.

What is claimed is:

1. A dielectric filter comprising:

a filter unit in which an electrode is formed at least on an inner peripheral surface of at least one hole extending in the axial direction in a parallelepiped-shaped dielectric member and on an outer peripheral surface in parallel with the hole to form an inner conductive member and an outer conductive member of a coaxial resonator;

a conductive terminal inserted into and mounted in the hole through an insert member made of dielectric material for input-output of signals:

said at least one hole having an insert portion having predetermined transverse dimensions for receiving the insert member at an opening portion of the hole;

the hole also having a stepped portion between the insert portion and a non-insert portion contiguous with the insert portion, for engaging an end of the insert member adjacent the non-insert portion;

the insert member inserted into the insert portion being blocked from moving toward the non-insert portion by the stepped portion;

said insert portion having a length substantially equal to or greater than a length of said insert member, so that said insert member does not substantially project from said opening portion of said hole when said insert member is in said insert portion;

wherein said hole comprises a through-hole and said insert portion is formed at at least one opening of said dielectric member at an end of said through-hole;

wherein the electrode is formed on both end faces and over the entire surface of the outer peripheral surface in parallel with the hole, and the electrode is provided with a predetermined gap at the insert portion of the inner peripheral surface of said hole.

2. The dielectric filter according to claim 1, wherein a cross-sectional shape of the insert portion of said hole is different from that of the non-insert portion.

3. A dielectric filter comprising:

a filter unit in which an electrode is formed at least on an inner peripheral surface of at least one hole extending in the axial direction in a parallelepiped-shaped dielectric member and on an outer peripheral surface in parallel with the hole to form an inner conductive member and an outer conductive member of a coaxial resonator;

a conductive terminal inserted into and mounted in the hole through an insert member made of dielectric material for input-output of signals;

said at least one hole having an insert portion having predetermined transverse dimensions for receiving the insert member at an opening portion of the hole;

the hole also having a stepped portion between the insert portion and a non-insert portion contiguous with the insert portion, for engaging an end of the insert member adjacent the non-insert portion;

the insert member inserted into the insert portion being blocked from moving toward the non-insert portion by the stepped portion;

said insert portion having a length substantially equal to or greater than a length of said insert member, so that said insert member does not substantially project from said opening portion of said hole when said insert member is in said insert portion;

wherein a cross-sectional shape of the insert portion of said hole is different from that of the non-insert portion.

4. The dielectric filter according to claim 3, wherein a cross-sectional area of the insert portion is substantially the same as that of the non-insert portion.

5. The dielectric filter according to any one of claims 1 or 3, wherein the outer peripheral surface of the insert member is adhered to the inner peripheral surface of the insert portion of said hole.

6. The dielectric filter according to any one of claims 1 or 3, wherein said insert member has an axial dimension which is shorter than an axial dimension of the insert portion, and a recess is generated at the insert portion and a cover is provided in said recess.

7. The dielectric filter according to claim 6, wherein said cover is provided by molding resin into said recess.

8. The dielectric filter according to any one of claims 1 or 3, wherein said insert member is provided at an end integrally with a frictional portion, and said frictional portion is sized and shaped for being pressingly inserted into the non-insert portion contiguous with the insert portion of said hole.

9. The dielectric filter according to claim 8, wherein said frictional portion has ridges for engaging the non-insert portion.

10. The dielectric filter according to claim 8, wherein said frictional portion is formed integrally with the insert member and of the same material.

11. A dielectric filter comprising:

a filter Unit in which an electrode is formed at least on an inner peripheral surface of at least one hole extending in the axial direction in a parallelepiped-shaped dielectric member and on an outer peripheral surface in parallel with the hole to form an inner conductive member and an outer conductive member of a coaxial resonator;

a conductive terminal inserted into and mounted in the hole through an insert member made of dielectric material for input-output of signals;

said at least one hole having an insert portion having predetermined transverse dimensions for receiving the insert member at an opening portion of the hole;

the hole also having a stepped portion between the insert portion and a non-insert portion contiguous with the insert portion, for engaging an end of the insert member adjacent the non-insert portion;

the insert member inserted into the insert portion being blocked from moving toward the non-insert portion by the stepped portion;

said insert portion having a length substantially equal to or greater than a length of said insert member, so that said insert member does not substantially project from said opening portion of said hole when said insert member is in said insert portion;

wherein said hole comprises a through-hole and said insert portion is formed at at least one opening of said dielectric member at an end of said through-hole;

wherein a retainer which is deformable radially inwardly end has a longer axial dimension than that of the non-insert portion of the hole with retainer pawls at its end is projected from the end of the insert member; the retainer passes through the non-insert portion contiguous with the insert portion of the hole; end the retainer pawls are retained at an end face of the dielectric member opposed to said insert portion.

12. The dielectric filter according to claim 11, wherein a second insert portion is formed at a second opening of said dielectric member at an opposite end of said through-hole.

13. A dielectric filter comprising:

a filter unit in which an electrode is formed at least on an inner peripheral surface of at least one hole extending in the axial direction in a parallelepiped-shaped dielectric member and on an outer peripheral surface in parallel with the hole to form an inner conductive member and an outer conductive member of a coaxial resonator;

a conductive terminal inserted into and mounted in the hole through an insert member made of dielectric material for input-output of signals;

said at least one hole having an insert portion having predetermined transverse dimensions for receiving the insert member at an opening portion of the hole;

the hole also having a stepped portion between the insert portion and a non-insert portion contiguous with the insert portion, for engaging an end of the insert member adjacent the non-insert portion;

the insert member inserted into the insert portion being blocked from moving toward the non-insert portion by the stepped portion;

said insert portion having a length substantially equal to or greater than a length of said insert member, so that said insert member does not substantially project from said opening portion of said hole when said insert member is in said insert portion;

wherein said hole comprises a through-hole end said insert portion is formed at at least one opening of said dielectric member at an end of said through-hole;

wherein a cross-sectional shape of the insert portion of said hole is different from that of the non-insert portion.

14. A dielectric filter comprising:

a filter unit in which an electrode is formed at least on an inner peripheral surface of at least one hole extending in the axial direction in a parallelepiped-shaped dielectric member and on an outer peripheral surface in parallel with the hole to form an inner conductive member end an outer conductive member of a coaxial resonator;

a conductive terminal inserted into and mounted in the hole through an insert member made of dielectric material for input-output of signals;

said at least one hole having an insert portion having predetermined transverse dimensions for receiving the insert member at an opening portion of the hole;

the hole also having a stepped portion between the insert portion and a non-insert portion contiguous with the insert portion, for engaging an end of the insert member adjacent the non-insert portion;

the insert member inserted into the insert portion being blocked from moving toward the non-insert portion by the stepped portion;

said insert portion having a length substantially equal to or greater then a length of said insert member, so that said insert member does not substantially project from said opening portion of said hole when said insert member is in said insert portion;

wherein said hole comprises a through-hole and said insert portion is formed at at least one opening of said dielectric member at an end of said through-hole;

wherein the inner conductive member and the outer conductive member of said coaxial resonator are short-circuited at ends thereof by said electrode being formed on an end face of the dielectric member where said conductive terminal is not mounted;

wherein a cross-sectional shape of the insert portion of said hole is different from that of the non-insert portion.

15. A dielectric filter comprising:

a filter unit in which an electrode is formed at least on an inner peripheral surface of at least one hole extending in the axial direction in a parallelepiped-shaped dielectric member and on an outer peripheral surface in parallel with the hole to form an inner conductive member and an outer conductive member of a coaxial resonator;

a conductive terminal inserted into end mounted in the hole through an insert member made of dielectric material for input-output of signals;

said at least one hole having an insert portion having predetermined transverse dimensions for receiving the insert member at an opening portion of the hole;

the hole also having a stepped portion between the insert portion and a non-insert portion contiguous with the insert portion, for engaging an end of the insert member adjacent the non-insert portion;

the insert member inserted into the insert portion being blocked from moving toward the non-insert portion by the stepped portion;

said insert portion having a length substantially equal to or greater than a length of said insert member, so that said insert member does not substantially project from said opening portion of said hole when said insert member is in said insert portion;

wherein a cross-sectional area of the insert portion is substantially the same as that of the non-insert portion.

16. The dielectric filter according to claim 15, wherein one of said portions is rounded and the other is polygonal.

17. A dielectric filter comprising:

a filter unit in which an electrode is formed at least on an inner peripheral surface of at least one hole extending in the axial direction in a parallelepiped-shaped dielectric member and on an outer peripheral surface in parallel with the hole to form an inner conductive member and an outer conductive member of a coaxial resonator;

a conductive terminal inserted into and mounted in the hole through an insert member made of dielectric material for input-output of signals;

said at least one hole having an insert portion having predetermined transverse dimensions for receiving the insert member at an opening portion of the hole;

the hole also having a stepped portion between the insert portion and a non-insert portion contiguous with the insert portion, for engaging an end of the insert member adjacent the non-insert portion;

the insert member inserted into the insert portion being blocked from moving toward the non-insert portion by the stepped portion;

said insert portion having a length substantially equal to or greater than a length of said insert member, so that said insert member does not substantially project from said opening portion of said hole when said insert member is in said insert portion;

wherein said hole comprises a through-hole and said insert portion is formed at at least one opening of said dielectric member at an end of said through-hole;

wherein a second insert portion is formed at a second opening of said dielectric member at an opposite end of said through-hose;

further comprising a second insert member disposed in said second insert portion.

18. A dielectric filter comprising:

a filter unit in which an electrode is formed at least on an inner peripheral surface of at least one hole extending in the axial direction in a parallelepiped-shaped dielectric member and on an outer peripheral surface in parallel with the hole to form an inner conductive member and an outer conductive member of a coaxial resonator;

a conductive terminal inserted into and mounted in the hole through an insert member made of dielectric material for input-output of signals;

said at least one hole having an insert portion having predetermined transverse dimensions for receiving the insert member at an opening portion of the hole;

the hole also having a stepped portion between the insert portion and a non-insert portion contiguous with the insert portion, for engaging an end of the insert member adjacent the non-insert portion;

the insert member inserted into the insert portion being blocked from moving toward the non-insert portion by the stepped portion;

wherein said insert member does not substantially project from said opening portion of said hole when said insert member is in said insert portion; and wherein said insert member has an axial dimension which is shorter then an axial dimension of the insert portion, and a recess is generated at the insert portion and a cover is provided in said recess.

19. The dielectric filter according to claim 18, wherein said hole comprises a through-hole and said insert portion is formed at at least one opening of said dielectric member at an end of said through-hole.

20. The dielectric filter according to claim 19, wherein the inner conductive member and the outer conductive member of said coaxial resonator are short-circuited at ends thereof by said electrode being formed on an end face the dielectric member where said conductive terminal is not mounted.

21. The dielectric filter according to claim 19, wherein a second insert portion is formed at a second opening of said dielectric member at an opposite end of said through-hole.

22. The dielectric filter according to any one of claims 18, 19, 20 or 21, wherein said cover is provided by molding resin into said recess.

23. A dielectric filter comprising:

a filter unit in which an electrode is formed at least on an inner peripheral surface of at least one hole extending in the axial direction in a parallelepiped-shaped dielectric member and on an outer peripheral surface in parallel with the hole to form an inner conductive member end an outer conductive member of a coaxial resonator;

a conductive terminal inserted into and mounted in the hole through an insert member made of dielectric material for input-output of signals;

said at least one hole having an insert portion having predetermined transverse dimensions for receiving the insert member at an opening portion of the hole;

the hole also having a stepped portion between the insert portion and a non-insert portion contiguous with the insert portion, for engaging an end of the insert member adjacent the non-insert portion;

the insert member inserted into the insert portion being blocked from moving toward the non-insert portion by the stepped portion;

said insert portion having a length substantially equal to or greater then a length of said insert member, so that said insert member does not substantially project from said opening portion of said hole when said insert member is in said insert portion;

wherein said insert member is provided at an end integrally with a frictional portion, and said frictional portion is sized end shaped for being pressingly inserted into the non-insert portion continuous with the insert portion of said hole.

24. The dielectric filter according to claim 23, wherein said hole comprises a through-hole and said insert portion is formed at at least one opening of said dielectric member at an end of said through-hole.

25. The dielectric filter according to claim 24, wherein the inner conductive member and the outer conductive member of said coaxial resonator are short-circuited at ends thereof by said electrode being formed on an end face of the dielectric member where said conductive terminal is not mounted.

26. The dielectric filter according to claim 24, wherein a second insert portion is formed at a second opening of said dielectric member at an opposite end of said through-hole.

27. The dielectric filter according to any one of claims 23, 24, 25 or 26, wherein said frictional portion has ridges for engaging the non-insert portion.

28. The dielectric filter according to any one of claims 23, 24, 25 or 26, wherein said frictional portion is formed integrally with the insert member and of the same material.

* * * * *